United States Patent [19]

Payne

[11] 4,153,084

[45] May 8, 1979

[54] MACHINE FOR USE IN FABRICATING PANELS FILLED WITH PULVERIZED INSULATION MATERIAL

[76] Inventor: Joe J. Payne, 1505 Daniels Ave., Escalon, Calif. 95320

[21] Appl. No.: 817,803

[22] Filed: Jul. 21, 1977

[51] Int. Cl.[2] ..... B65B 1/24

[52] U.S. Cl. ..... 141/80; 100/153; 100/156; 141/125; 141/131

[58] Field of Search ..... 141/12, 71, 73, 78, 141/80, 125, 129, 131, 163, 237, 280, 283, 324, 325, 121; 222/368, 238; 100/121, 118, 151, 153, 156, 210, 152; 53/24, 36, 124 R, 239, 124 CC, 121

[56] References Cited

U.S. PATENT DOCUMENTS

| | | | |
|---|---|---|---|
| 664,260 | 12/1900 | Gaunt | 141/129 |
| 782,459 | 2/1905 | Morris | 222/368 |
| 2,789,406 | 4/1957 | Mosier | 53/118 |
| 4,020,881 | 5/1977 | Nöthen | 141/125 |

*Primary Examiner*—Richard E. Aegerter
*Assistant Examiner*—Frederick R. Schmidt
*Attorney, Agent, or Firm*—Huebner & Worrel

[57] ABSTRACT

A machine characterized by a horizontally oriented conveyor for transporting an open-sided wall panel, a chute having a discharge orifice at its lower end for filling the panel with pulverized cellulose fibers, and a series of roller brushes transversely related to the path of the panel for alternately packing the cellulose in the panel and sweeping excess material therefrom.

11 Claims, 5 Drawing Figures

MACHINE FOR USE IN FABRICATING PANELS FILLED WITH PULVERIZED INSULATION MATERIAL

BACKGROUND OF THE INVENTION

1. Field of the Invention

The invention generally relates to panel fabricating machines and more particularly to a machine for use in filling panel components with pulverized insulation materials such as pulverized cellulose fiber and the like.

Construction panels, during fabrication, often are filled prior to completion using manual techniques. Such panels frequently include a myriad of open ended cells formed of flexible honeycomb within which pulverized cellulose is deposited. The cells serve to support the pulverized cellulose in place within the panel regardless of its orientation.

2. Description of the Prior Art

As can be appreciated by those familiar with the art of fabricating insulation-filled panels, pulverized cellulose fibers rate highly as an insulation material. Frequently, construction panels, such as wall panels and the like, are insulated by blowing or otherwise introducing pulverized cellulose fibers therein subsequent to completion of fabrication thereof. The disadvantages of such techniques are readily apparent.

Attempts have been made to overcome inherent difficulties encountered in filling such panels by forming the panels with an open side and thereafter depositing therein pulverized material, such as cellulose fiber, and thereafter closing the panel. Unfortunately, when known techniques are employed, attendant labor costs are substantial. This results, in part, from the fact that cellulose fiber is difficult to handle and, consequently, difficult to introduce and compress in a panel during its fabrication. It should therefore be appreciated that there currently exists a need for a simple technique for economically filling wall panels and the like with insulation material such as cellulose fiber.

It is therefore the general purpose of the instant invention to provide a simple, economic machine for automating insulation of panels, such as wall panels and the like, employing pulverized insulating materials, such as pulverized cellulose fibers, whereby insulation-filled construction panels are economically provided to be supplied at a construction site in completed form.

OBJECTS AND SUMMARY OF THE INVENTION

It is an object of the instant invention to provide an economic and improved insulation-filled construction panel.

It is another object to provide an improved method for filling a construction panel with pulverized insulation material.

It is another object to provide an improved method for packing pulverized insulation material in an open-sided construction panel during its fabrication.

It is another object to provide for use in a construction panel fabricating machine means for filling and packing a partially completed construction panel.

It is another object to provide in a panel fabricating machine means for packing pulverized insultation material within an open-sided panel.

It is another object to provide in a panel fabricating machine a conveyor for conveying a partially completed panel beneath a metering chute adapted to introduce pulverized insulation material into the partially completed panel and a series of roller brushes for alternately packing the insulation material in the panel and sweeping excess material from the surface thereof.

Another object is to provide in a panel fabricating machine means for filling a partially completed construction panel with pulverized cellulose fibers, although not necessarily restricted in use thereto since the machine may be employed equally as well in filling construction panels with pulverized material, other than cellulose fibers.

These together with other objects and advantages are achieved through the use of a pulverizing chamber having a shredder disposed therein, a horizontally oriented conveyor for delivering a compacted mass of cellulose fiber to the chamber for pulverizing the cellulose fiber, an endless conveyor for conveying an open-sided construction panel along a horizontal path, a metering chute for delivering pulverized cellulose fibers downwardly into the open-sided panel, and a series of roller brushes having surfaces disposed in horizontal, vertically spaced planes for alternately compressing the material into the panel, prior to its completion, and sweeping excess material from the top of the panel.

DESCRIPTION OF THE PREFERRED EMBODIMENT

Figure 1:
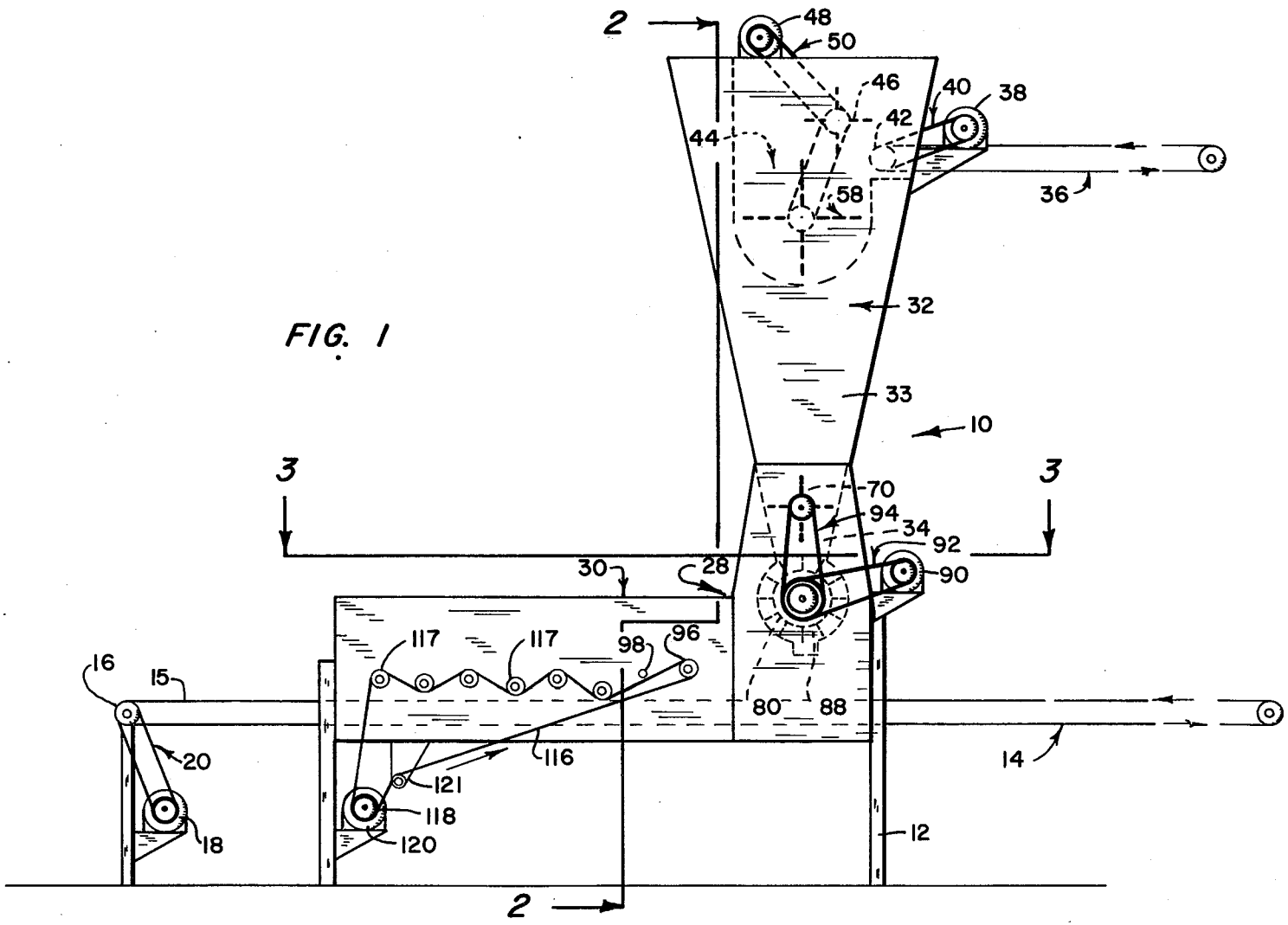
FIG. 1 is a fragmented side elevational view of a machine embodying the principles of the instant invention.

Referring now to the drawings with more particularity, wherein like reference characters designate like or corresponding parts throughout the several views, there is shown in FIG. 1 a machine 10 embodying the principles of the instant invention.

It is to be understood that the machine 10 is fabricated from suitable metal stock utilizing known techniques of fabrication. Therefore a specific description of the techniques employed in the fabrication of the machine 10 is omitted in the interest of brevity. However, it is to be understood that the machine 10 includes a suitable frame 12 fabricated from stock material adapted to be arranged in a given work space and bolted or otherwise rigidly affixed in place, preparatory to operation.

Upon the frame 12 there is mounted an endless horizontal conveyor, generally designated 14. The conveyor 14 includes an endless belt designated 15, trained about a suitable idler, not designated, and a drive roller 16. The drive roller 16, in turn, is driven by a motor 18 coupled thereto through a belt-and-sheave coupling 20, of known design. Since the motor and belt-and-sheave coupling are of a suitable known design, a detailed description thereof is omitted. Moreover, while not shown, it is to be understood that where desired the belt 15 also is of a known design and may, where desired, include a chain link belt, or a series of conveyor chains spaced apart a distance sufficient to permit insulation material to fall therebetween. Further, the conveyor 15 may comprise powered rollers instead of an endless belt, chains and the like. It any event, it is to be understood that the conveyor 14 serves to advance a construction panel component 22, FIG. 4, at a uniform rate along a horizontal path for purposes as will hereinafter become more readily apparent.

Figure 5:
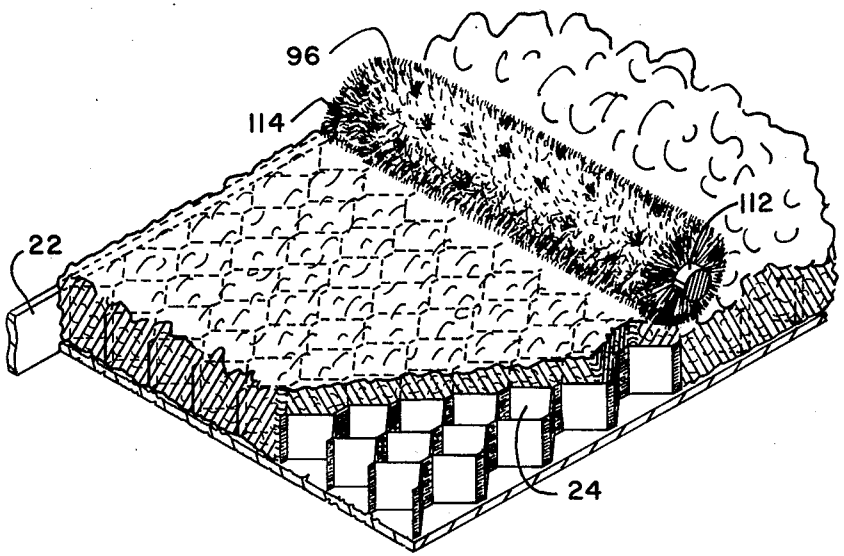
FIG. 5 is a perspective view depicting an operation for one of the roller brushes shown in FIGS. 3 and 4.

The construction panel component 22, as shown, comprises an open-sided, partially completed construction panel component. As illustrated in FIG. 5, within the panel component 22 there is arranged a series of open-ended cells 24 formed of a suitable flexible honeycomb material within which is deposited pulverized cellulose fiber, generally designated 26, FIG. 4. The cells 24, of course, serve to support the cellulose fiber in place within the panel regardless of the panel's orientation.

Figure 4:
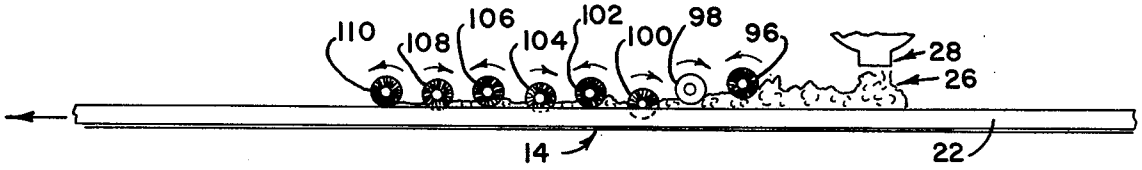
FIG. 4 is a fragmented side elevational view illustrating an arrangement of roller brushes provided for the compression section of the machine shown in FIG. 3.

In order to introduce the pulverized cellulose fibers into the partially completed construction panel 22, as it is conveyed by the conveyor 14, the construction panel component 22 is conveyed through a delivery station 28, FIG. 4, at which the cellulose fiber 26 is permitted to gravitate into the open-end cells 24 of the component 22. From the delivery station 28, the panel component 22 is conveyed to a compression section, generally designated 30, at which pulverized cellulose fiber is compressed in the cells 24, without subjecting the cells to damage, as will hereinafter become more readily apparent.

The delivery station 28, as shown, includes a chute 32 having a throat 34 disposed at its lowermost end through which pulverized cellulose fiber is permitted to gravitate downwardly into the panel component 22. As a practical matter, the cellulose fiber 26 is supplied in compact bales from which the cellulose fiber must be separated prior to pulverization. Hence, in order to supply pulverized cellulose fiber 26 to the delivery station 28, there is provided a first conveyor 36 the purpose of which is to feed solid or compacted masses of cellulose fibers to the machine 10.

The particular manner in which the conveyor 36 is supported is deemed to be a matter of convenience. However, the conveyor 36, as shown, is driven by a motor 38 connected with the conveyor through a suitable sheave-and-belt drive coupling, generally designated 40. Preferably, the motor 38 is intermittenly energized, in response to closing of an electrical switch located between the motor and a suitable source of energy for advancing a compacted mass or base of cellulose fibers to the terminal end portion, designated 42, of the conveyor. From this end of the conveyor, the cellulose fiber is discharged into a pulverizing chamber, generally designated 44. However, in order to assist in the delivery of the compacted mass of pulverized cellulose fibers to the pulverizing chamber 44, there is provided a shredding roller 46 driven by a suitable electrically driven motor 48. This motor is connected to the roller 46 through a suitable belt-and-sheave coupling 50.

Figure 2:
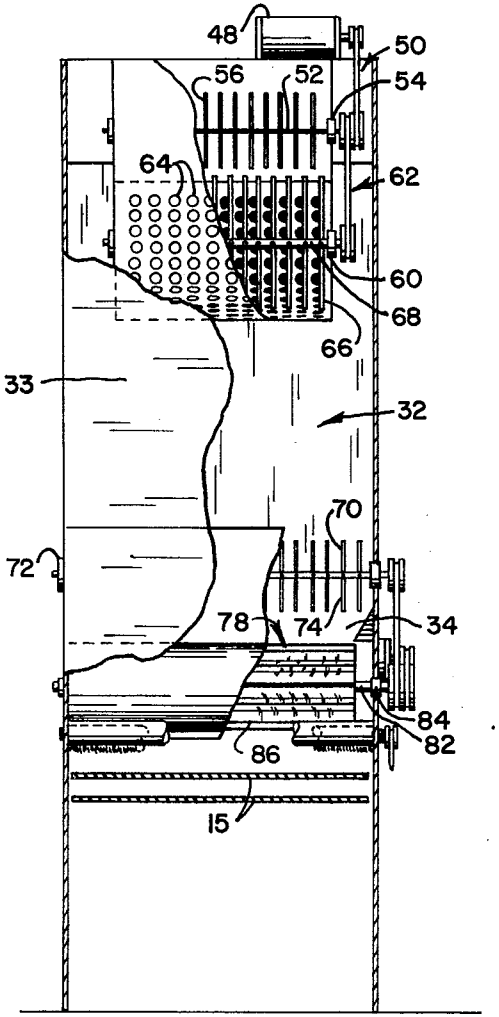
FIG. 2 is a partially sectioned, fragmented end elevational view of the machine, taken generally along line 2—2 of FIG. 1.
Figure 3:
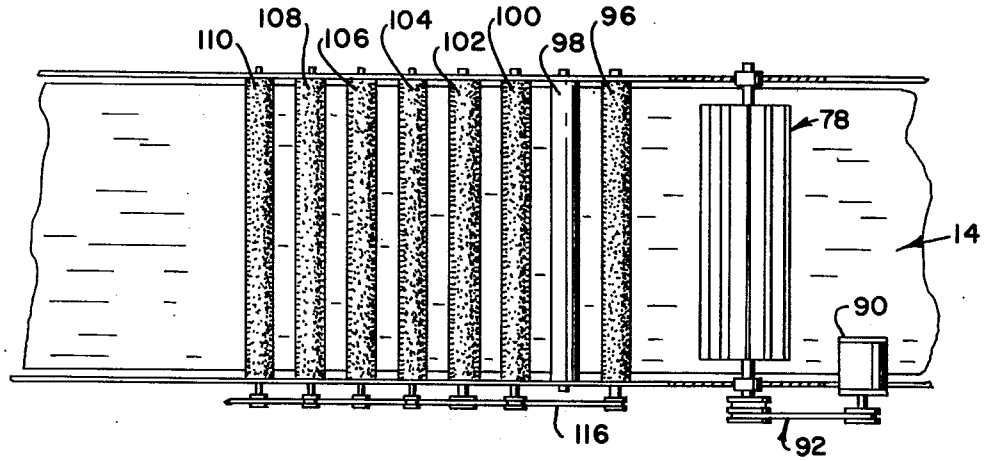
FIG. 3 is a fragmented top-plan view of a compression section for the machine shown in FIGS. 1 and 2.

It will be appreciated, from a review of FIG. 2, that the roller 46 includes a concentric shaft 52 supported at each of its opposite ends by suitable bearings 54 and includes a plurality of radially extended tines 56 which engage and tear the compacted cellulose fibers into smaller components or bits as the material passes between a bite defined by the shredding roller and the end portion 42 of the conveyor 36.

Disposed beneath the shredding roller 46, within the pulverizing chamber 44, there is a pulverizing roller 58. This roller also is supported for rotation by suitable bearings designated 60. Preferably, the pulverizing roller 58 also is connected to be driven through a suitable belt-and-sheave drive coupling 62 by the shredding roller 46 so that the rollers 46 and 58 are simultaneously driven by the motor 48.

It is important to note that the pulverizing chamber 44 is formed of a generally grid-like material having formed therein a myriad of openings 64. The dimensions of these openings are, of course, such as to pass pulverized cellulose fiber therethrough. Thus the pulverizing chamber 44 also is caused to serve as a screen for screening the cellulose fiber, just prior to its being discharged downwardly through the chute 32 to the throat 34.

In order to assure that the cellulose fiber 26 is pulverized within the pulverizing chamber 44, the pulverizing roller 58 also includes a plurality of tines 66 oriented 90° apart and affixed to a common drive shaft 68, FIG. 2. The tines 68 of the pulverizing roller 58 preferably are formed of a suitable relatively stiff, bristle-like material. Where desired, the pulverizing roller 58 is afforded the configuration of a paddle-wheel, not shown.

Immediately above the throat 34 of the chute 32, there is provided an agitating roller 70. This roller is supported by suitable bearings 72 and is similar in design to the pulverizing roller 58. As shown, the agitating roller includes linear arrays of tines 74 oriented 90° apart on a common shaft 68. Hence, it should be appreciated that as the pulverized cellulose fiber gravitates downwardly through the chute 32, it is engaged by the agitating roller 70 which, in effect, prevents the pulverized cellulose fibers from becoming compacted in the throat 34.

Immediately beneath the agitating roller 70 there is provided a metering device, generally designated 78, the purpose of which is to control the rate at which pulverized cellulose fiber 26 is caused to gravitate from the throat 74. While the metering device 78 is of any suitable design, as shown the roller includes a cylindrical body 80 supported for rotation by a shaft 82 mounted in bearings 84 located at opposite ends of the shaft 82. About the periphery of the cylindrical body 80 there is provided a plurality of longitudinally oriented vanes 86 defining therebetween spaces 88 within which pulverized cellulose fiber is collected. As the metering roller 78 is driven in rotation, the cellulose fiber is discharged from the lowermost end of the throat 34 of the chute 32.

As a practical matter, the metering roller 78 is driven in rotation by a suitable motor 90 coupled thereto through a drive coupling, designated 92, similar in design and construction to the drive coupling 50. In practice, the motor 90 is employed, also, to drive the agitating roller 70 through a drive coupling, generally designated 94, suitably coupled in driven relation with the drive coupling 92, as illustrated in FIG. 1.

In any event, it should be apparent that as an open-sided construction panel 22 is conveyed beneath the throat 34 of the chute 32, pulverized cellulose fiber is deposited in the cells 24 of the panel. The cellulose fiber 26 is deposited in quantities which, because of its bulk, appears to constitute an excess quantity and projects upwardly from the uppermost surface of the construction panel component 22, as the panel exits the delivery station 28, FIG. 4.

The compression section 30 includes a series of rotary brushes, designated 96, 100, 102, 104, 106, 108 and 110 of a similar design, while a free-running steel cylinder 98 is provided as a compaction roller in sequence with the roller 98.

As shown in FIG. 5, the rotary brush 96 includes a shaft 112 upon which is mounted a plurality of bristle tufts 114. The lengths of the tufts 114 are such that the tufts are permitted to flex as they engage the cellulose fiber deposited on the panel component 22.

The bristle tufts 114 project downwardly to terminate in vertically spaced planes. For example, note that the ends of the bristle tufts 114 for the rotary brush 96 reach the lowermost point of their orbit about the shaft 112 in a plane substantially above the plane of the upper surface of the panel component 22 to perform a sweeping function while the bristle tufts 114 of the rotary brush 100 extend downwardly into the panel 22, preferably one-half inch, for performing a packing function. The bristles of the brush 102 project downwardly and terminate, however, in a plane substantially coincident with the plane of the top surface of the panel 22 and are employed to perform a sweeping function. The bristles of the roller brush 104 project downwardly into the panel 22 a distance approximately a quarter of an inch, while the bristles of the brush 108 extend a slightly lesser distance into the panel, for performing a packing function in a manner similar to that in which the bristles of the rotary brush 100 perform a packing function. The roller brush 106 and the roller brush 110 are of a design and function in a manner quite similar to the brush 102 for performing a sweeping function. Accordingly, a detailed description of each of the brushes is omitted in the interest of brevity. It is to be understood, of course, that each of the rollers 96 through 110 are suitably supported for rotation about axes extended in spaced parallelism and that the bristles of the roller brushes are flexible in order to avoid damaging the honeycomb cellular structure during packing operations.

The rollers 96 and 100 through 110 are each driven in rotation by means of a belt 116 trained about a sheave 117 affixed to the respective shafts for these rollers. The belt 116 also is trained about a sheave 118, FIG. 1, connected with the output shaft of a motor 120 provided for driving the belt 116. A belt tightener 121 is provided for controlling the tension of the belt 116, where so desired.

The motor 120 preferably comprises an electrically energizable motor of suitable design. As a practical matter, the belt 116 is so trained about the sheaves 117 that the rollers 96, 102, 106, and 110 are driven in a direction opposite to that in which the panel 22 is advanced by the conveyor 14 while the rollers 100, 104 and 108 advance in a direction corresponding to the direction of advancement of the panel component 22. Thus the rollers 96, 102, 106 and 110 perform a sweeping function while the rollers 100, 104 and 108 follow the panel and compress the insulation 26 downwardly into the honeycomb cells 24. It is imperative that the rollers 100, 104 and 108 be driven at an angular velocity such that the surface speed thereof is substantially equal to the linear speed of the belt 15 of the endless conveyor 14 so that the bristles of these brushes perform a packing function without experiencing horizontal motion relative to the panel component 22.

In view of the foregoing, it should be apparent that as the panel component 22 exits the compacting station 30 the cellulose fiber 26 is firmly packed into the cells 24 of the panel.

OPERATION

It is believed that in view of the foregoing description, the operation of the device will readily be understood and it will be briefly reviewed at this point.

With the machine 10 assembled in the manner hereinbefore described, it is prepared for use in fabricating construction panel components by placing a panel component 22 on the conveyor 14 with an upwardly facing open side. An open bale of insulation material, such as cellulose fiber, is placed on the conveyor 36. The endless conveyor 14 now is caused to advance through an energization of the motor 18 while the conveyor 36 causes a compact mass of cellulose fiber to advance toward the pulverizing chamber 44. As the mass of cellulose fiber is caused to project from the terminal end portion 42 of the conveyor 36, the shredding roller 46 tears fragments of cellulose fiber from the mass or open bale and deposits them in the chamber 44. Due to the rotation imparted to the pulverizing roller 58, the fragments of cellulose fiber are reduced in size, and thus are pulverized. The pulverized cellulose fiber is forced through openings 64 in the chamber 44 and gravitates downwardly through the chute 32 to engage the rotating agitating roller 70. Rotation of this roller prevents the chute 32 from becoming clogged. As the agitating roller 70 is driven in rotation, through operation of the drive couplings 94 and 92, the pulverized cellulose fiber is deposited in the metering roller 78. As the roller 78 is caused to rotate simultaneously with the agitating roller 70, pulverized material is deposited on the upper surface of the panel component 22, as it advances through the station 28. The cellulose fiber is deposited on the upper surface of the panel component 22 in a quantity such that a body of the material projects as a mound above the surface of the panel component. Upon exiting the station 28, the mound of cellulose fiber is engaged by the rotary brush 96 which has the effect of distributing the pulverized cellulose fiber over the surface of the panel. After passing beneath the rotary brush 96, the cellulose fiber is engaged by the steel packing roller 98 which serves to provide an initial packing force to the surface of the now distributed cellulose fiber. The material is then engaged by the bristles of the rotary brush 100, as they are advanced at an angular velocity such that the end portions thereof achieve a speed substantially equal to the speed of the linear displacement of the conveyor 14 upon which the panel component 22 is supported. The bristles of the brush 100 tend to flex and thus provide a resilient compaction force for forcing pulverized cellulose fibers downwardly into the individual cells 24. Upon exiting from beneath the rotary brush 100, the upper surface of the panel component is swept through a rotation of the rotary brush 102. Compaction of the cellulose fibers in the cell is again achieved as the material is passed beneath the rotary brush 104 which projects into the cells 24 a distance less than that to which the bristles of the roller 100 project. As the material exits the rotary brush 104, it is caused to pass beneath the roller 106 which again performs a sweeping function, in a manner similar to that in which the brush 102 performs a similar function. Finally, the cellulose fibers contained within the cells 24 are passed beneath the rotary brush 108 the bristle tufts of which project a lesser distance into the cells 24 for performing a final packing function. A final sweeping of the upper surface of the component is achieved as the material confined within the cell 24 passes beneath the final rotary brush 110.

Of course, once the panel 22 exits the compacting station 30, the upwardly facing opening of the panel is closed in any suitable manner, which forms no specific part of the instant invention.

In view of the foregoing, it should be apparent that the machine 10 which embodies the principles of the instant invention provides a practical solution to the perplexing problem of introducing cellulose fiber materials into the cells of construction panels during fabrication thereof so that the panels may be delivered to a work site in a completed condition and employed in any orientation with the pulverized cellulose fiber being uniformly distributed throughout the panel.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In a machine for use in fabricating panels filled with an insulation material of a substantially pulverized texture, the improvement comprising:

A. endless conveyor means for transporting at a linear velocity along a horizontally oriented path a panel component having an upwardly facing open side for receiving insulation material;

B. metering means disposed above said path for introducing into the panel compressible insulation material; and C. packing means for compressing said insulation material in said panel component, as the panel component is transported by said conveyor means at said linear velocity including a series of rollers of substantially cylindrical configurations disposed above and transversely related to said path, each of said rollers being characterized by radially extended flexible bristles having lengths such that the bristles project downwardly into the open side of the panel component as the component is transported beneath the roller for applying to material introduced into the component downwardly acting compressive forces, and drive means connected to said plurality of rollers for driving the rollers at angular velocities such that the surface velocity of each of the rollers corresponds to the linear velocity of the panel component as it is transported by the conveyor means.

2. The combination of claim 1 wherein said metering means includes a vertically oriented chute characterized by a throat and a rotating gate supported for angular displacement within said throat.

3. The combination of claim 2 wherein said metering means includes a means for pulverizing cellulose fiber and means for introducing pulverized cellulose fiber into the throat of said chute.

4. In a machine for use in fabricating panels filled with an insulation material of a substantially pulverized texture, the combination comprising:

A. conveyor means for conveying a panel component having an upwardly facing open side along a substantially horizontal path comprising an endless belt for conveying said component along said path at a selected rate;

B. metering means for introducing into the panel compressible insulation material of a substantially pulverized texture as the panel is conveyed along said path;

C. packing means for compressing said insulation material in said panel component as the panel component is conveyed by said conveyor means, comprising a first plurality of packing rollers characterized by radially extended bristles dimensioned to extend downwardly into said panel, a second plurality of rollers interposed in alternating relation with said first plurality of rollers characterized by radially extended bristles dimensioned to extend short of said panel, and means simultaneously imparting to the rollers of said first plurality of rollers angular displacement at a surface speed and in a direction corresponding to the speed and direction of said conveyor, and means for imparting to the rollers of the second plurality of rollers angular displacement in a direction opposite to the direction of the displacement of the rollers of said first plurality of rollers.

5. The combination of claim 4 wherein said metering means includes means for serially conveying bales of cellulose fiber to the metering means, means for pulverizing bales of cellulose fibers, and means for facilitating gravitating delivery of pulverized cellulose fibers into said panel component including a vertically oriented chute disposed above said endless belt.

6. The combination of claim 5 wherein the component includes flexible means defining therein a plurality of upwardly opening cells for receiving pulverized cellulose fibers and the bristles of the first plurality of rollers are dimensioned to enter said cells and are characterized by a coefficient of rigidity sufficient to compact said cellulose fiber in said cells.

7. In a machine particularly suited for use in filling wall panel components with pulverized cellulose fibers delivered to the machine in a compacted mass, the combination comprising:

A. means for pulverizing cellulose fibers including a screen defining a pulverizing chamber, and a rotary brush for agitating cellulose fibers delivered to the chamber;

B. means for delivering a compacted mass of cellulose fiber to said chamber including a first endless conveyor characterized by a horizontal run having a terminal end disposed in close proximity with said chamber, and means including a separator roller disposed in contiguous relation with the terminal end of the horizontal run of said first endless conveyor for separating the compacted mass;

C. means including a second endless conveyor adapted to convey a panel characterized by an upwardly facing open side along a substantially horizontal path;

D. metering means including a vertically oriented chute having a throat disposed beneath the pulverizing chamber and means including a rotary gate disposed in said throat for metering a gravitating flow of pulverized cellulose fiber through said throat into said panel component as the component is conveyed by said second endless conveyor; and E. packing means including a plurality of roller brushes having radially extended bristles disposed above the path of the panel component in transverse relation therewith for packing said pulverized cellulose fiber into said panel component as the component is conveyed along said path.

8. The machine of claim 7 further comprising means for imparting to said roller brushes angular displacement in a direction and at a velocity such that the surface speeds thereof correspond to the surface speed and direction of travel for said second endless conveyor.

9. The machine of claim 8 wherein the bristles of said roller brushes extend downwardly to different vertically spaced planes.

10. The machine of claim 9 further comprising another plurality of roller brushes having radially extended bristles interposed in an alternating relationship with said roller brushes of said first plurality, and means connected with the roller brushes of said second plurality for imparting thereto angular displacement in a direction opposite to the direction of the angular displacement imparted to said first plurality of roller brushes.

11. The machine of claim 10 wherein the bristles of said other plurality of roller brushes extend to a substantially common plane.

* * * * *